US008292409B2

(12) United States Patent
Ueda

(10) Patent No.: US 8,292,409 B2
(45) Date of Patent: Oct. 23, 2012

(54) INK JET HEAD

(75) Inventor: Masato Ueda, Akishima (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 214 days.

(21) Appl. No.: 12/933,671

(22) PCT Filed: Feb. 18, 2009

(86) PCT No.: PCT/JP2009/052761

§ 371 (c)(1),
(2), (4) Date: Sep. 20, 2010

(87) PCT Pub. No.: WO2009/119190

PCT Pub. Date: Oct. 1, 2009

(65) Prior Publication Data

US 2011/0018922 A1 Jan. 27, 2011

(30) Foreign Application Priority Data

Mar. 27, 2008 (JP) ..... 2008-083852

(51) Int. Cl.
*B41J 2/045* (2006.01)

(52) U.S. Cl. ..... 347/69; 347/71

(58) Field of Classification Search ..... 347/69–71
See application file for complete search history.

(56) References Cited

U.S. PATENT DOCUMENTS

| | | | | |
|---|---|---|---|---|
| 2005/0083379 | A1 | 4/2005 | Chikamoto | |
| 2006/0055741 | A1 | 3/2006 | Watanabe et al. | |
| 2007/0070125 | A1* | 3/2007 | Watanabe | 347/58 |
| 2007/0222911 | A1 | 9/2007 | Murase | |
| 2008/0088679 | A1* | 4/2008 | Watanabe | 347/69 |

FOREIGN PATENT DOCUMENTS

| | | | |
|---|---|---|---|
| JP | 2000-071448 | A | 3/2000 |
| JP | 2001-171122 | A | 6/2001 |
| JP | 2005-216242 | A | 8/2005 |

* cited by examiner

*Primary Examiner* — Julian Huffman

*Assistant Examiner* — Sharon A Polk

(74) *Attorney, Agent, or Firm* — Holtz, Holtz, Goodman & Chick, PC

(57) ABSTRACT

Disclosed is an ink jet head exhibiting good assemblability while protecting an electrode portion. An ink jet head (10) comprising a head chip (2) including drive walls (22) and channels (23) juxtaposed alternately with a drive electrode (25) being formed on the drive wall (22), and a nozzle plate (24) wherein a connection electrode is formed on the rear surface of the head chip (2), a wiring board (3) on which an electrode portion (32) is formed is bonded to project from the head chip (2), and ink in the channel (23) is ejected by causing shear deformation of the drive wall (22) is further provided with a holding member (5) disposed at a position covering the electrode portion (32) and holding a portion (31) of the wiring board (3) projecting from the head chip (2), and an electrode portion protection member (4) bonded between the holding member (5) and the electrode portion (32) using adhesive and having a thickness in the range of 0.01-0.5 mm at a part covering the electrode portion (32).

12 Claims, 5 Drawing Sheets

INK JET HEAD

This application is the United States national phase application of International Application PCT/JP2009/052761 filed Feb. 18, 2009.

TECHNICAL FIELD

The present invention relates to an ink jet head, and specifically to an ink jet head having a structure for protecting an electrical connecting section in a head chip.

BACKGROUND TECHNOLOGY

Regarding an ink jet head installed in an ink jet printer, an ink jet head is conventionally known where a piezoelectric element is provided to each nozzle for ejecting ink, and by making shear deformation of this piezoelectric element an ink is ejected from the each nozzle.

As one type of head chip to be used in this kind of ink jet head, a head chip in which drive walls and channels are juxtaposed alternately is commonly known.

In this type of head chip a drive electrode is formed for each channel, and a connection electrode for connecting with the drive electrode is formed on an upper surface of the head chip. On the upper surface of the head chip, a wiring board which is formed with an electrode portion corresponding to the connection electrode is bonded such that the connection electrode and the electrode portion are electrically connected (for example, refer to Patent Document 1).

By making the head chip to have this type of structure, an ink jet head can be realized that is easy for manufacturing process, easy for connecting the drive electrode with an external wiring, and compact to lower the cost.

Patent Document 1: Unexamined Japanese Patent Application Publication No. 2006-82396.

DISCLOSURE OF THE INVENTION

Problems to be Solved by the Invention

In this type of the head chip, since the electrode portion formed at the wiring board tends to be easily peeled off or broken away, it is necessary to take a measure for preventing a stress on the electrode portion.

In particular, in cases where the electrode portion is formed on the wiring board made of a ceramic by aluminum evaporation and the like, strength of bonding between the electrode portion and the wiring board body is weak such that the electrode portion may be peeled off by a small deformation, thus the electrode portion needs to be protected.

However in cases of adopting the head chip of the above described structure, since the distance between the electrode portion and other member adjacent to the electrode portion is extremely small, if it is tried to make the gap between the electrode portion and the other member in order to prevent the stress being applied to the electrode portion, an assembling work may become very difficult.

Further, in a case of trying to coat a filling material for protecting the electrode portion, the problem arises that it is very difficult to coat the filling material thinly and without generating pinholes and the like in a small gap between the electrode portion and the other member.

In view of the above described points, objectives of the present invention is to provide an ink jet head of easy assembling in addition to protecting the electrode portion of the wiring board.

Means to Solve the Problems

In order to solve the above described problems, an ink jet head described in claim 1 is provided with: a head chip including a drive wall and a channel juxtaposed alternately, an outlet and an inlet of the channel arranged respectively at a front surface and a rear surface of the chip, and a drive electrode formed on the drive wall; a nozzle plate provided with a nozzle for ejecting ink, at a corresponding position to the channel on the front surface of the head chip; a connection electrode to electrically connect to the drive electrode, formed on the rear surface of the head chip; and wiring board on which an electrode portion is formed for applying a voltage from a drive circuit to the drive electrode via the connection electrode, the wiring board being bonded to project from the head chip in a direction perpendicular to a channel array direction; wherein the ink jet head ejects the ink in the channel from the nozzle by applying the voltage to the drive electrode and causing a shear deformation on the drive wall, the ink jet head characterizing in further comprising a holding member disposed at a position covering the electrode portion and holds a portion of the wiring board projecting from the head chip; and an electrode portion protection member bonded between the holding member and the electrode portion by using adhesive, and having a thickness in the range of 0.01-0.5 mm at a part covering the electrode portion.

The ink jet head described in claim 2 is the ink jet head described in claim 1, wherein the electrode portion protection member is made of polytetrafluoroethylene or polyolefin.

The ink jet head described in claim 3 is the ink jet head described in claim 1 or 2, wherein the drive wall is made of a ceramic comprising leadzilconatetitanate.

The ink jet head described in claim 4 is the ink jet head described in any one of claims 1-3, wherein the adhesive is an epoxy type adhesive.

The ink jet head described in claim 4 is the ink jet head described in any one of claims 1-4, further including a cap member disposed in a periphery of an ink ejection surface of the nozzle plate, wherein the holding member is provided between the cap member and the electrode portion.

Effect of the Invention

According to the invention described in claim 1, 3, 4, or 5, in an ink jet head having a very small gap between the electrode portion and the other member adjacent to the electrode portion, by disposing the electrode portion protection member in the gap between the electrode portion and the other member adjacent to the electrode portion, the electrode portion protection member may be peeled off instead of the electrode portion in case of a stress being applied to the electrode portion. Due to this, the broken away of the electrode portion is protected, and generation of disconnection in wiring can be prevented. Namely, the electrode portion can be protected.

According to the invention described in claim 2, since the electrode potion protection member is made of polytetrafluoroethylene or polyolefin, an adhesion force of the electrode potion protection member is weak. Therefore, the electrode portion protection member may be firstly peeled off instead of the electrode portion in case of a stress being applied to the electrode portion. Due to this, the separation of the electrode portion is protected, and breakage of wiring can be prevented. Namely, the electrode portion can be protected.

EXPLANATION OF SIGNS

Figure 1:
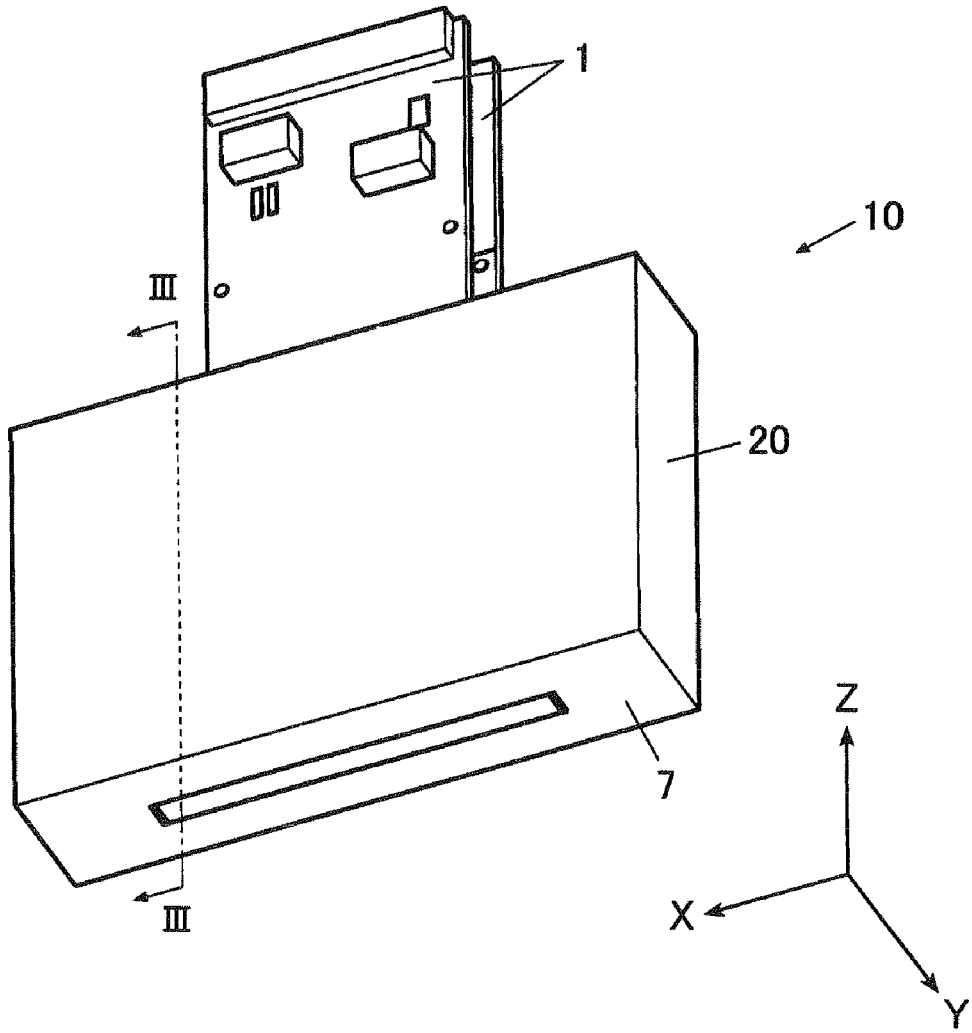
FIG. 1 is a perspective view showing a total structure of the ink jet head relating to the present embodiment.

1: flexible substrate
11: bending portion
2: head chip
21: substrate
22: drive wall
23: channel
24: nozzle plate
25: drive electrode
3: wiring board
31: projection portion
32: electrode portion
33: opening
4: electrode portion protection member
41: opening
5: holding member
51: opening
52: bottom plate
53: side wall
6: radiator plate
7: cap member
71: opening
8: manifold
81: flow path connection section
10: ink jet head
20: chassis

DETAILED DESCRIPTION OF THE PREFERRED EMBODIMENT

Hereinafter, embodiments of the ink jet head relating to the present embodiment will be described, however the scope of invention is not restricted with illustrated examples.

Figure 2:
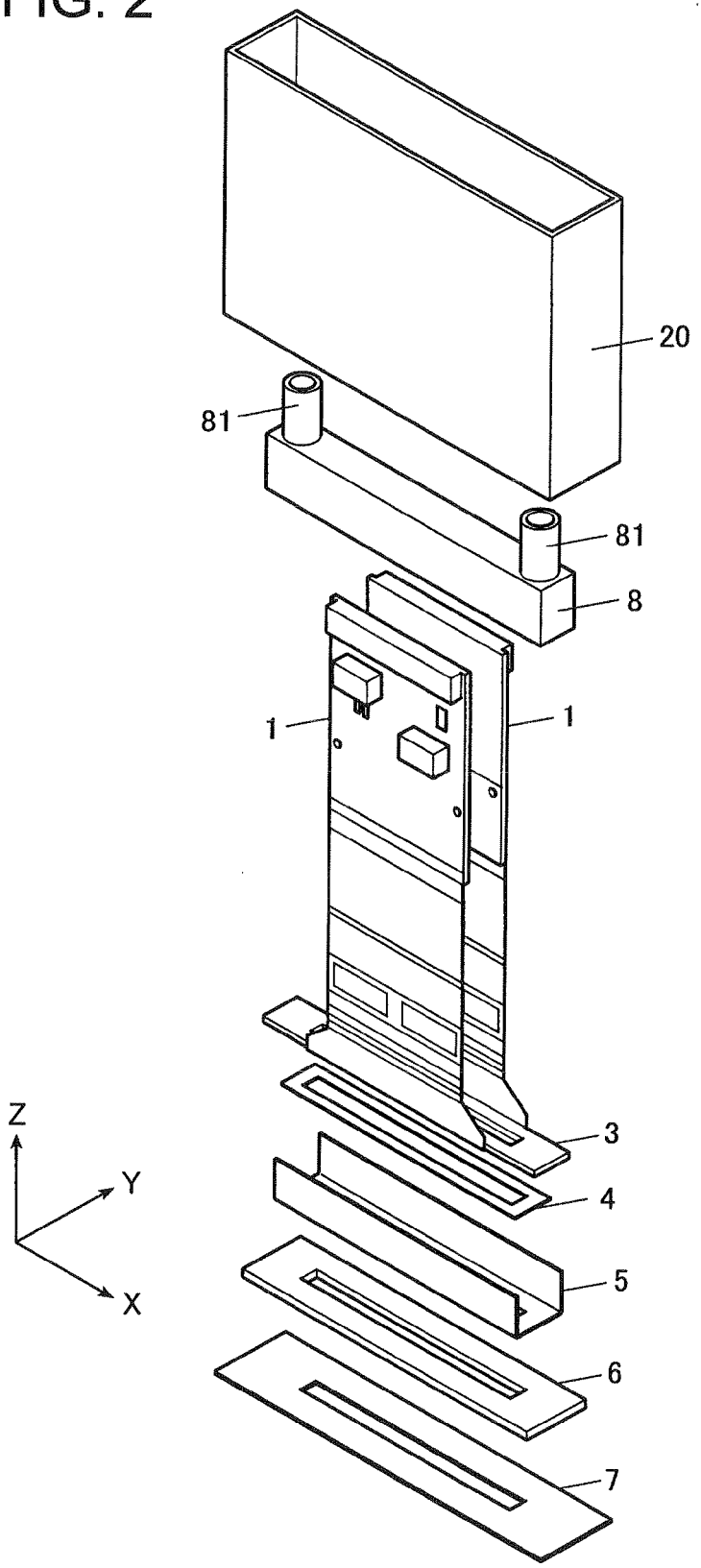
FIG. 2 is an exploded perspective view of the inkjet head shown in FIG. 1.
Figure 3:
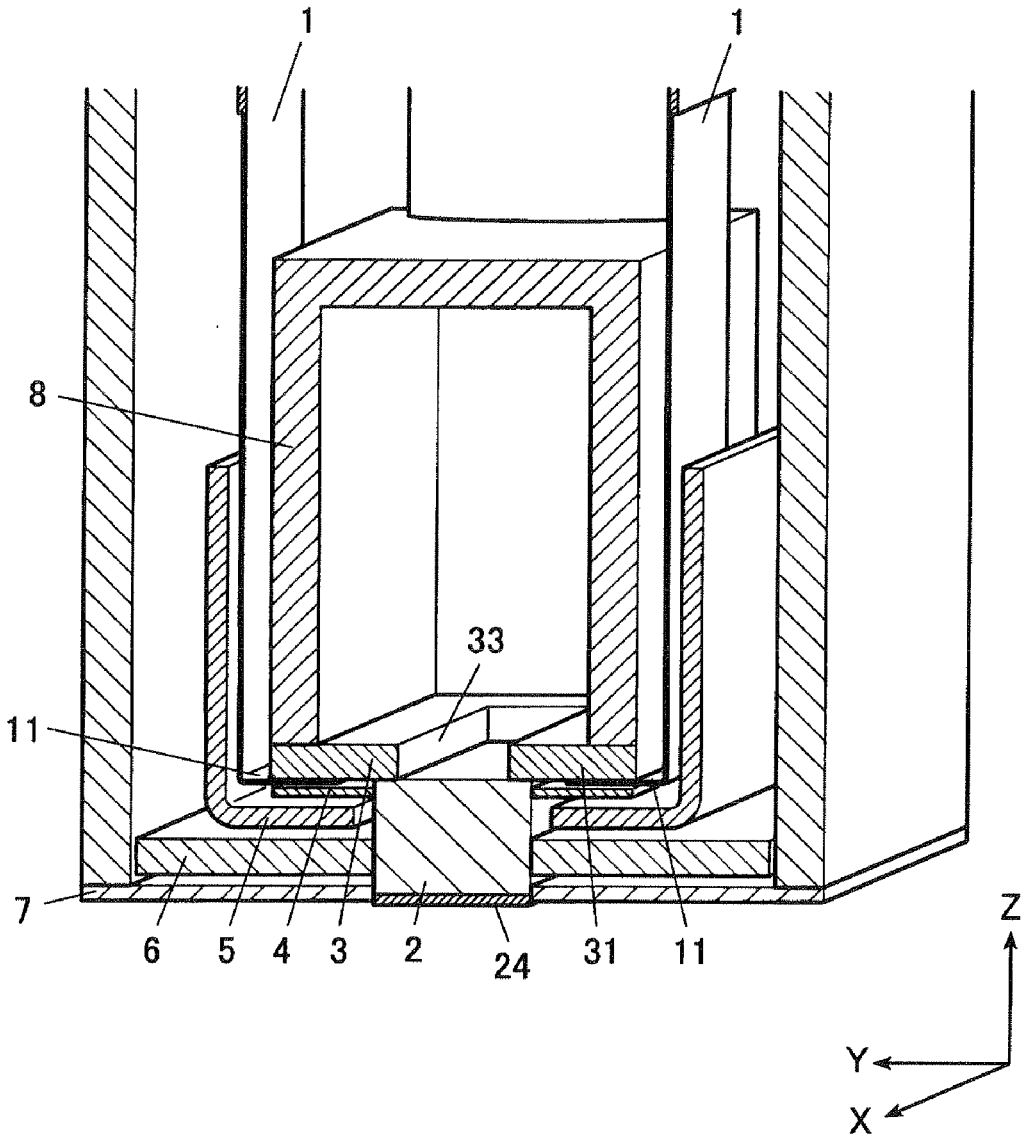
FIG. 3 is a section view of the inkjet head shown in FIG. 1.
Figure 4:
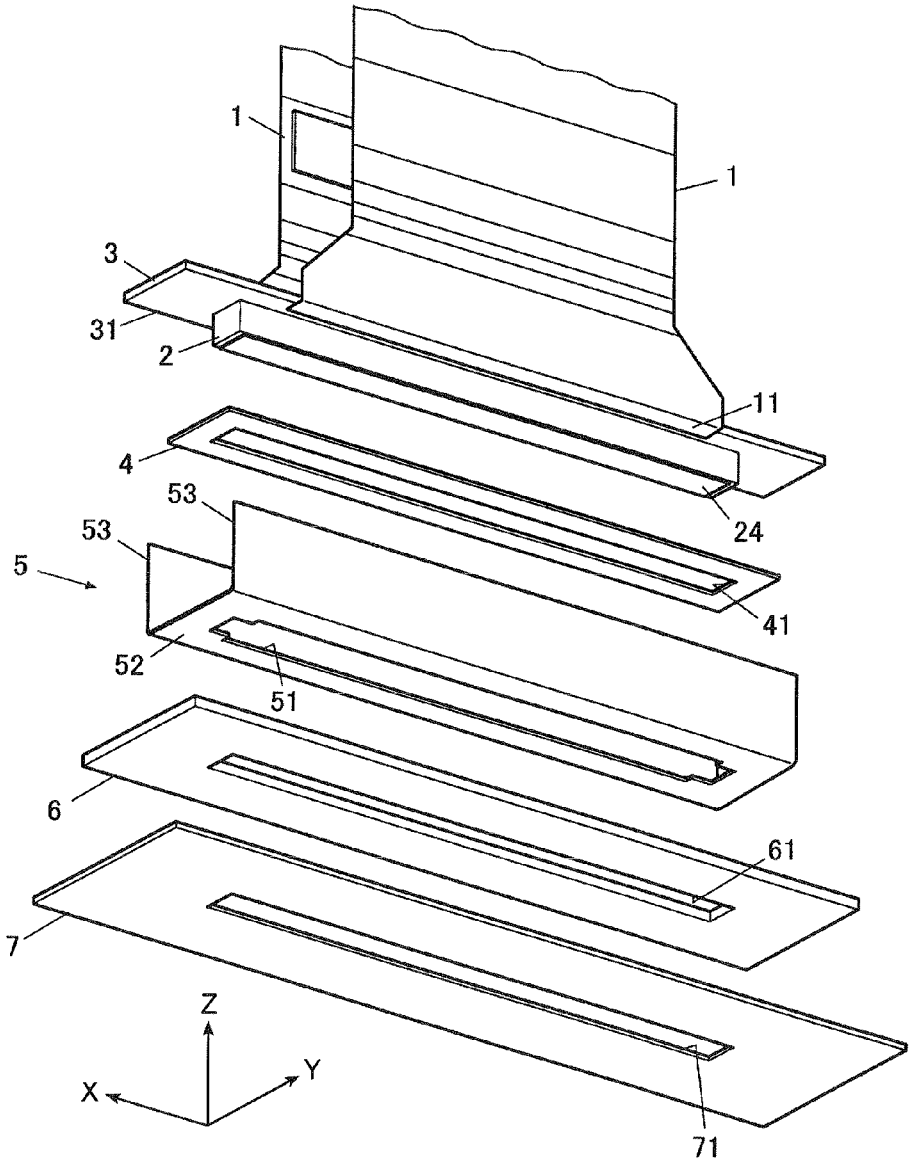
FIG. 4 is an exploded perspective view showing a structure of main part of the inkjet head shown in FIG. 1.

FIG. 1 shows a perspective view showing an external appearance of the ink jet head relating to the present embodiment, FIG. 2 is an exploded perspective view of the inkjet head shown in FIG. 1 and FIG. 3 is a section view of the inkjet head taken on line III-III of FIG. 1. FIG. 4 is an exploded perspective view showing a structure of main part of the ink jet head shown in FIG. 1. Wherein, XYZ axis common to all the above figures is shown in each figure. As shown in FIG. 1 through FIG. 3, ink jet head 10 has a chassis 20 open in upper and bottom surfaces. As shown in FIG. 3, inside of chassis 20 assembled and arranged are flexible substrates 1, 1, head chip 2, wiring board 3, electrode portion protection member 4, holding member 5, radiator plate 6, cap member 7, manifold 8, etc., and cap member is provided on the bottom surface of chassis 20.

Among them, flexible substrates 1, 1 are formed of plane substrates as shown in FIG. 2, and arranged with a prescribed distance with each other. On each of flexible substrates 1, 1 an unillustrated drive circuit and the like are mounted. Further, on the lower end portions of the flexible substrates 1, 1, bent portions 11, 11 are provided to be faced as oppositely bent, and on the upper surface of the bent portions 11, 11, wiring board 3 (described later) is provided. And, in a space formed with a pair of flexible substrates 1, 1 and an upper surface of wiring board 3, manifold 8 (to be described later) is provided. Further, the upper end portions of flexible substrates 1, 1, are projected upward from the upper surface of chassis 20.

Figure 5:
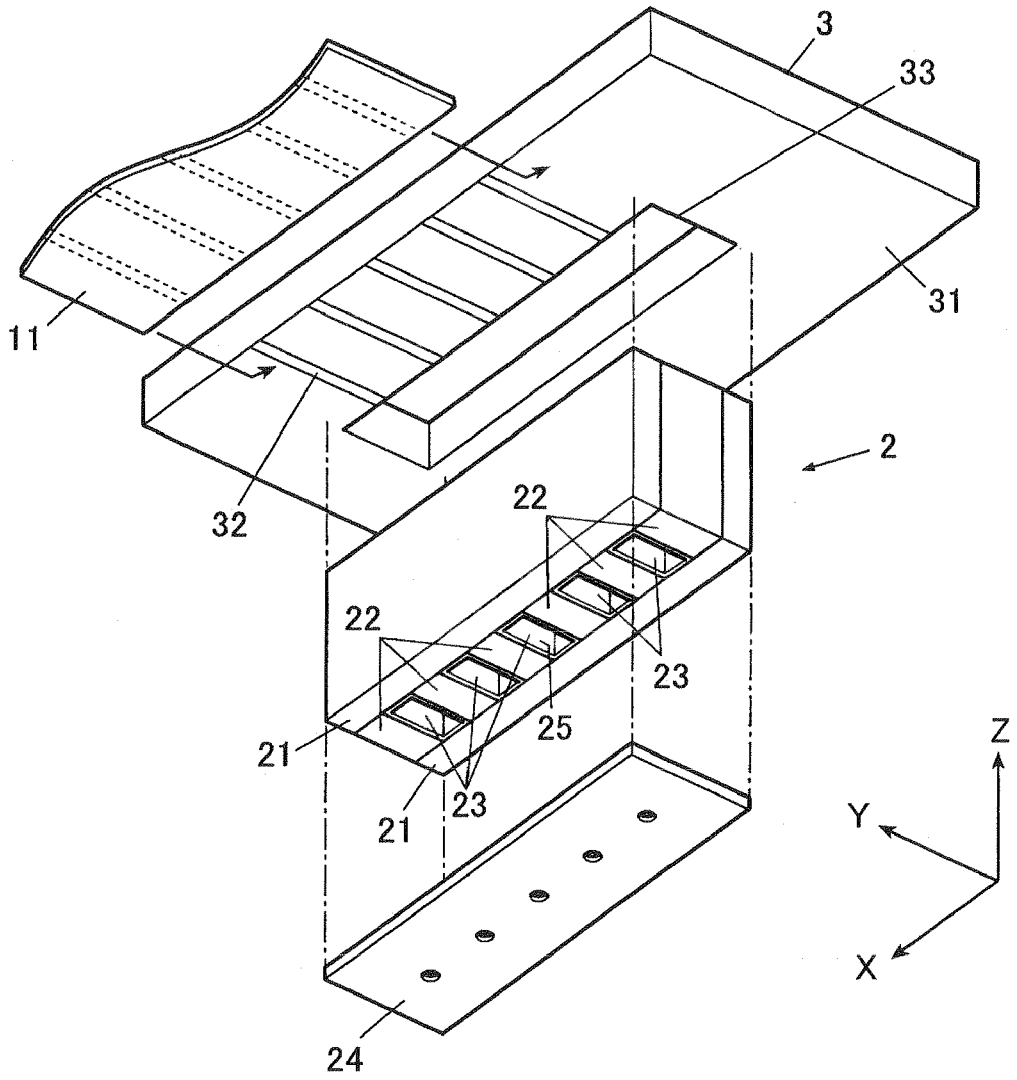
FIG. 5 is an exploded perspective view of the head chip relating to the present embodiment.

Head chip 2 has a structure where drive wall 22 and channel 23 are alternately arranged between two substrates 21, 21 as shown in FIG. 5. On the bottom surface (front surface) of head chip 2, provided is nozzle plate 24 in which an ink ejection hole is arranged at a position corresponding to each channel 23.

Here, drive wall 22 is formed of a piezoelectric element which generates a deformation by applying a voltage. Commonly known materials can be utilized as a piezoelectric material, while lead zirconate titanate (PZT) is preferable.

On an inner wall of each channel 23 drive electrode 25, which being a metal layer independent for each channel 23, is formed, and drive electrode 25 is electrically connected to an unillustrated connecting electrode formed on the upper surface of head chip 2 (a surface facing to wiring board 3) for each channel 23.

Further, on the upper surface (rear surface) of head chip 2, wiring board 3, which being connected to the above described flexible substrate 1, 1, is bonded.

Wiring board 3 is formed with larger longitudinal and width sizes compared to those of head chip 2, and has projection portion 31 which is protruded from head chip 2 in a bonded state with head chip 2.

On lower surface of wiring board 3 (the surface facing to head chip 2), electrode portions 32 are formed with the same number and same pitch as the connecting electrodes. Electrode portion 32 is connected to the connecting electrode when wiring board 3 is attached to head chip 2. Thus, electrode portion 32 is connected to drive electrode 25 through the connection electrode.

Further, on wiring board 3, a rectangular opening 33 is formed being elongated in the longitudinal direction (X direction). Opening 33 is formed to be a size such that every opening of channel 23 is able to be exposed. While, since opening 33 is made to have a smaller surface area than the surface area of head chip 2, in the case of attaching wiring board 3 onto head chip 2, head chip 2 is surely prevented from passing through wiring board 3. Therefore, in the case of bonding wiring board 3 onto head chip 2, wiring board 3 does not block off the opening of channel 23 while contacting substrates 21, 21.

Wiring board 3 is formed of plastics or glass and the like having low coefficient of thermal expansion. As wiring board 3, ceramics such as non-polarized PZT or AlN can be used. Further, in order to prevent the generation of deformation in head chip 2 caused by difference of thermal expansion, materials having the difference of thermal expansion coefficient of ±1 ppm or less can be preferably utilized wiring board 3.

At the position where electrode portion 32 is formed on projection portion 31, bending portions 11, 11 are attached, thus electrode portion 32 of wiring board 3 and the drive circuit of flexible substrates 1, 1 are electrically connected. Thus, signals from the drive circuit of flexible substrates 1, 1 are enabled to be applied onto drive electrode 25 on the inner wall of each channel 23 in head chip 2 through bending portions 11, 11 and electrode portion 32 of flexible substrates 1, 1.

Further, in the under side of projection portion 31, electrode portion protection member 4 is provided as shown in FIG. 4.

Electrode portion protection member 4 has opening 41 with the same size as head chip 2, and head chip 2 is inserted in opening 41. In this case, the upper surface of electrode portion protection member 4 covers electrode section 32 of wiring board 3 via bending portions 11, 11. By this configuration, stress on electrode section 32 is eased. Electrode portion protection member 4 is adhered to wiring board 3 by the use of epoxy-type adhesive.

As a material for electrode portion protection member 4, resins with low adhesive property may be used, while the use of polytetrafluoroethylene (PTFE) or polyolefin is preferable. By utilizing the material with low adhesive property as electrode portion protection member 4, in cases where stress of heat shock and the like is induced on electrode portion 32, electrode portion protection member 4 is made to be peeled off instead of electrode portion 32.

Electrode portion protection member 4, has a thickness raging within 0.01 to 0.5 mm at a portion of covering electrode portion 32. Namely, either the maximum or minimum values of the thickness of electrode portion protection member 4 at the portion of covering electrode portion 32 is designed to be within the above range. In the present embodiment, electrode portion protection member 4 having approximately uniform thickness within the above range is utilized.

Further, under the electrode portion protection member 4, holding member 5 to hold projection portion 31 of wiring board 3 bonded onto head chip 2 is provided.

Holding member 5 is configured to have bottom plate 52 formed with a rectangular opening 51, and side wall 53 raising from both sides of bottom plate 52 toward electrode portion protection member 4. Bottom plate 52 has a width approximately same as wiring board 3, and opening 51 is formed to be approximately same as nozzle plate 24.

Head chip 2 is set in opening 51, while wiring board 3 is placed on the upper surface of bottom plate 52 of holding member 5. Therefore, flexible substrate 1, 1 is also arranged inside of holding member 5 and, flexible substrates 1, 1 and side wall 53 of holding member 5 is made approximately in parallel.

Further, under holding member 5, tabular radiator plate 6 is provided.

Radiator plate has opening 61 having the same size as nozzle plate 24, and head chip 2 is set in the opening 61 such that an upper surface of radiator plate 6 contacts a bottom surface of holding member 5.

Under radiator plate 6, cap member 7 is provided.

Cap member 7 is a rectangular plane plate and provided under side of cassis 20.

In cap member 7, opening 71 which has the same size with nozzle plate 24 is provided. Nozzle plate 24 is set in opening 7 such that an ink ejection surface of nozzle plate 24 and a bottom surface of cap member 7 are arranged in a same plane. In this way, since cap member 7 is arranged in the periphery of ink ejection surface of muzzle plate 24, breakage of the ink ejection surface of nozzle plate 24, which may be caused by contact with other member, can be prevented and head chip 2 is configured to be protected.

Although it is explained in the above description that an ink ejection surface of nozzle plate 24 and a bottom surface of cap member 7 are arranged in a same plane, "arranged in a same plane" does not necessary mean an exactly same plane, but may be arranged for example, such that the ink ejection surface of the nozzle plate 24 is arranged at a depressed position compared to the lower surface of cap member 7, or a concave depression is formed in the periphery of nozzle plate according to the size of opening 71.

Further, the surface of cap member 7 is made water-shedding, and prevents the ink adhesion on the surface due to ink splash in case of ejecting ink from head chip 2.

Further, cap member 7 may function as a suction lip to tightly contact with a suction cap in a case of maintenance work of head chip 2.

The maintenance work is for example a suction removal work that is conducted in cases where an ejection hole is clogged due to thickening or solidification of ink caused by evaporation of ink solvent in the ejection hole at the time of image formation by utilizing high viscosity ink, or the ejection hole is clogged due to generation of air bubble of dirt in an ink flow path connecting to the ejection hole.

At this time, the suction cap contacts cap member 7 in the periphery of head chip 2 so as to cover the lower and surface of head chip 2 where ink ejection hole being arranged, and a suction pump connected to the suction cap sucks the ink and the like remained in the ejection hole of nozzle plate 24 in head chip 2.

Manifold 8 is made in box shape having open bottom surface, being disposed in the space formed with a pair of flexible substrates 1, 1 and the upper surface of wiring board 3, and keeping the ink inside.

At right and left two positions on the upper surface of manifold 8, flow path connection sections 81, 81 is dispose as shown in FIG. 2, and to unillustrated ink supply pipes are connected to flow path connection section 81.

Further, as shown in FIG. 3, manifold 8 is formed to be coincide with the periphery of projection portion 31 of upper surface in wiring board 3, thus an ink room common to all channel 23 is formed.

Meanwhile, it is possible to interpose a heater and the like, between cap member 7 and nozzle plate 24, for heating the ink according to need.

Although in the present embodiment explained is that electrode protection member 4 is fixed to wiring board 3 via flexible substrates 1, 1, electrode protection member 4 may be directly fixed to the exposed area of electrode portion 32 in the wiring board 3. Further electrode protection member 4 only needs to be fixed at a position covering electrode portion 32, for example may be adhered on the upper surface of bottom plate 52 of holding member 5.

Further, holding member 5, radiator plate 6, and cap member 7 may be unified to form a holding member. In this case the holding member functions as a radiator plate and a cap member.

Further, without providing radiator plate 6, holding member 5 and cap member 7 may be unified to form a holding member. In this case the holding member functions as a cap member.

Next, operations of the present embodiment will be explained.

In the ink jet head 10 structured as described above, by attaching wiring board 3 on the upper surface of head chip 2, drive electrode 25 and electrode portion 32 of wiring board 3 are electrically connected for each channel 23 of head chip 2.

When signals relating to ink ejection are sent to ink jet head 10, the signals transfer from the wiring of flexible substrates 1, 1 through electrode portion 32 of wiring board 3, to the connection electrode of head chip 2 and arrive to drive electrode 25. Thus, drive wall 22 formed of piezoelectric element is shear deformed to apply pressure to the ink in channel 23, and the ink is ejected from the nozzle formed in nozzle plate 24.

Next, effect of the present embodiment will be explained.

In ink jet head of the present embodiment, by providing electrode protection member 4 having weaker adhesion property than electrode portion 32 between electrode portion 32 connected with bending portion 11, 11 of flexible substrates 1, 1 and the member disposed under the bottom face of electrode portion 32, in cases where heat shock is imposed for example, electrode portion 32 is kept without being peeled off since electrode protection member 4 is firstly peeled off.

As described above, by providing electrode protection member 4 between electrode portion 32 and the member disposed under the bottom face of electrode portion 32, and by firstly peeling off electrode protection member 4 in the case where stress is applied to electrode portion 32, the peeling off of electrode portion 32 can be prevented and generation of disconnection can be prevented. Thus, electrode portion can be protected.

Further, by providing electrode protection member 4, in the case of coating adhesive, the adhesive can be evenly coated due to the surface contact between electrode protection member 4 and bending portion 11, which leads to improve working efficiency.

EXAMPLE

The present invention will be described by using examples. However, the present invention shall not be restricted by the examples.

Examples 1-5

As shown in Table 1 below, electrode protection members made of PTFE having thickness of 0.05 mm-0.5 mm are mounted on the above described ink jet head 10 in which the distance between the cap member and the wiring board is arranged to be 1 mm or 2 mm. And, the ink jet head was subjected to three cycle heat shock tests of heating and cooling within the temperature range of −20° C. to 80° C. After the heat shock test, conditions of wiring connection were checked and evaluated as described below.

<<Evaluation>>

A: There is no generation of disconnection in the electrode portion.

B: There are slight generations of disconnections in the electrode portion.

C: There are generations of disconnections in the electrode portion.

Comparative Examples 1-3

As shown in Table 1 below, electrode protection member made of PTFE having thickness of 0.8 mm or 1.0 mm are mounted on the above described ink jet head 10 in which the distance between the cap member and the wiring board is arranged to be 2 mm or 3 mm. And, the ink jet head was subjected to the same heat shock tests as the above, and similarly evaluated.

Examples 6-8

As shown in Table 1 below, electrode protection member made of polyethylene (PE) having thickness of 0.1 mm, 0.2 mm or 0.5 mm are mounted on the above described ink jet head 10 in which the distance between the cap member and the wiring board is arranged to be 1 mm. And, the ink jet head was subjected to the same heat shock tests as the above, and similarly evaluated.

Comparative Examples 4 and 5

As shown in Table 1 below, electrode protection member made of polyethylene (PE) having thickness of 0.1 mm is mounted on the above described ink jet head 10 in which the distance between the cap member and the wiring board is arranged to be 1 mm or 2 mm. And, the ink jet head was subjected to the same heat shock tests as the above, and similarly evaluated. Wherein, in Comparative Example 4, holding member 5 and radiator plate 6 are not provided.

TABLE 1

| | Electrode protection member | | Distance b/w cap member and wiring board | |
|---|---|---|---|---|
| | Material | Thickness [mm] | [mm] | Evaluation |
| Example 1 | PTFE | 0.05 | 1 | A |
| Example 2 | PTFE | 0.1 | 1 | A |
| Example 3 | PTFE | 0.2 | 1 | A |
| Example 4 | PTFE | 0.5 | 1 | A |
| Example 5 | PTFE | 0.5 | 2 | A |
| Comp. Example 1 | PTFE | 0.8 | 2 | B |
| Comp. Example 2 | PTFE | 1.0 | 2 | C |
| Comp. Example 3 | PTFE | 1.0 | 3 | B |
| Example 6 | PE | 0.1 | 1 | A |
| Example 7 | PE | 0.2 | 1 | A |
| Example 8 | PE | 0.5 | 1 | A |
| Comp. Example 4 | PE | 1.0 | 1 | C |
| Comp. Example 5 | PE | 1.0 | 2 | C |

Note:
Comp. Example means Comparative Example.

From the above result, generation of disconnection in the electrode portion was not observed in cases of providing the electrode protection member having thickness of 0.05 mm-0.5 mm, and generation of disconnection was confirmed in cases of providing the electrode protection member having thickness of 0.8 mm or 1.0 mm.

The electrode protection member having thickness of less than 0.05 mm is presumed to be effective, however in cases where the thickness of the electrode protection member is less than 0.01 mm, forming of the member may become difficult, and the thickness of the electrode protection member is preferable in the range 0.01 mm-0.5 mm from a view point of practical usage.

Other than the above, the present invention is appropriately changeable, being not restricted the above described embodiments.

The invention claimed is:

1. An ink jet head comprising:

a head chip which comprises a drive wall and a channel juxtaposed alternately, an outlet and an inlet of the channel being arranged respectively at a front surface and a rear surface of the chip, and a drive electrode formed on the drive wall;

a nozzle plate provided with a nozzle for ejecting ink, at a corresponding position to the channel on the front surface of the head chip;

a connection electrode to electrically connect to the drive electrode, formed on the rear surface of the head chip; and a wiring board on which an electrode portion is formed for applying a voltage from a drive circuit to the drive electrode via the connection electrode, the wiring board being bonded to project from the head chip in a direction perpendicular to a channel array direction, wherein the ink jet head ejects the ink in the channel from the nozzle by applying the voltage to the drive electrode to cause a shear deformation on the drive wall, the ink jet head characterizing in further comprising:

a holding member disposed at a position covering the electrode portion to hold a portion of the wiring board projecting from the head chip; and an electrode portion protection member bonded between the holding member and the electrode portion by using adhesive, and having a thickness in the range of 0.01 mm-0.5 mm at a part covering the electrode portion.

2. The ink jet head described in claim 1, wherein the electrode portion protection member is made of polytetrafluoroethylene or polyolefin.

3. The ink jet head described in claim 2, wherein the drive wall is made of a ceramic comprising leadzilconatetitanate.

4. The ink jet head described in claim 3, wherein the adhesive is an epoxy type adhesive.

5. The ink jet head described in claim 4, further including a cap member disposed in a periphery of an ink ejection surface of the nozzle plate, wherein the holding member is provided between the cap member and the electrode portion.

6. The ink jet head described in claim 3, further including a cap member disposed in a periphery of an ink ejection surface of the nozzle plate, wherein the holding member is provided between the cap member and the electrode portion.

7. The ink jet head described in claim 2, wherein the adhesive is an epoxy type adhesive.

8. The ink jet head described in claim 7, further including a cap member disposed in a periphery of an ink ejection surface of the nozzle plate, wherein the holding member is provided between the cap member and the electrode portion.

9. The ink jet head described in claim 2, further including a cap member disposed in a periphery of an ink ejection surface of the nozzle plate, wherein the holding member is provided between the cap member and the electrode portion.

10. The ink jet head described in claim 1, wherein the drive wall is made of a ceramic comprising leadzilconatetitanate.

11. The ink jet head described in claim 1, wherein the adhesive is an epoxy type adhesive.

12. The ink jet head described in claim 1, further including a cap member disposed in a periphery of an ink ejection surface of the nozzle plate, wherein the holding member is provided between the cap member and the electrode portion.

* * * * *